US009982873B1

(12) United States Patent
Hsieh

(10) Patent No.: US 9,982,873 B1
(45) Date of Patent: May 29, 2018

(54) LAMP HAVING A ONE PIECE MOLDED BULB SEATS FACING TWO DIRECTIONS

(71) Applicant: HABITEX CORPORATION, Taipei (TW)

(72) Inventor: Pei-Lin Hsieh, Taipei (TW)

(73) Assignee: HABITEX CORPORATION, Taipei (TW)

( * ) Notice: Subject to any disclaimer, the term of this patent is extended or adjusted under 35 U.S.C. 154(b) by 14 days.

(21) Appl. No.: 15/404,557

(22) Filed: Jan. 12, 2017

(51) Int. Cl.

| | |
|---|---|
| ***F21V 19/00*** | (2006.01) |
| ***F21V 1/00*** | (2006.01) |
| ***F21V 17/00*** | (2006.01) |
| ***F21V 23/00*** | (2015.01) |

(52) U.S. Cl.
CPC ..... *F21V 19/006* (2013.01); *F21V 1/00* (2013.01); *F21V 17/002* (2013.01); *F21V 23/001* (2013.01)

(58) Field of Classification Search
CPC .. F21V 19/006; F21V 19/0065; F21V 19/007; F21V 17/002; H01R 33/22
See application file for complete search history.

(56) References Cited

U.S. PATENT DOCUMENTS

| | | | | |
|---|---|---|---|---|
| 1,756,309 A * | 4/1930 | Schweiker | ..... | F21V 19/006 362/249.01 |
| 1,936,423 A * | 11/1933 | Clemence | ..... | H01R 33/92 439/643 |
| 2011/0189894 A1* | 8/2011 | Hirsh | ..... | F21V 19/006 439/620.02 |

* cited by examiner

*Primary Examiner* — Robert May
(74) *Attorney, Agent, or Firm* — Hamre, Schuman, Mueller & Larson, P.C.

(57) ABSTRACT

A lamp includes a seat unit, a lampshade, two bulb connectors, and a circuit unit having two wires. The seat unit has outer and inner seats, and opposite bulb seats molded as one piece with the inner seat. Each of the bulb seats has a guiding hole and a mounting surface. The mounting surfaces respectively face toward two directions that are transverse to each other. Each bulb connector has a main portion formed with a connecting opening for insertion of a bulb, and a fixing portion fixedly connected to a respective one of the bulb seats, such that the connecting openings are oriented respectively toward the two directions. The wires respectively extend through the guiding holes for being electrically connected to the bulb connectors.

6 Claims, 10 Drawing Sheets

LAMP HAVING A ONE PIECE MOLDED BULB SEATS FACING TWO DIRECTIONS

FIELD

The disclosure relates to a lamp, and more particularly to a lamp adapted to be connected to two bulbs.

BACKGROUND

Referring to FIGS. 1 and 2, a conventional lamp is adapted to be supported by a stand (not shown) to serve as a standing lamp. The conventional lamp includes a lamp seat 91 and a lampshade 92. The lamp seat 91 includes a cup body 911, a metal round plate body 912, a metal support body 913, and two bulb connectors 914. The cup body 911 is substantially trumpet-shaped, and is connected to the lampshade 92. The round plate body 912 is fastened onto the lampshade 92 with screws. The support body 913 is elongated, and has a middle section 9131 welded on the round plate body 912, and two bent sections 9132 respectively extending from opposite ends of the middle section 9131. The bulb connectors 914 are respectively welded on the bent sections 9132, such that the bulb connectors 914 are respectively oriented toward two directions which are transverse to each other. Each of the bulb connectors 914 is formed with an opening that is adapted to receive a bulb 915, such that the bulb 915 is oriented toward a respective one of the two directions.

Since the conventional lamp includes a substantial number of the abovementioned components, which are individually manufactured, assembling of such components is relatively time-consuming. In addition, welding and screwing processes of some of the abovementioned components render assembling of the conventional lamp even more troublesome.

SUMMARY

Therefore, an object of the disclosure is to provide a lamp that can alleviate at least one of the drawbacks associated with the abovementioned prior art.

Accordingly, the lamp includes a seat unit, a lampshade, two bulb connectors, and a circuit unit. The seat unit has an outer seat, an inner seat disposed in the outer seat, and opposite bulb seats molded as one piece with the inner seat. Each of the bulb seats has a mounting surface and a guiding hole. The mounting surfaces of the bulb seats respectively face toward two directions which are transverse to each other. The lampshade is connected to the seat unit. Each of the bulb connectors has a main portion and a fixing portion. The main portion is formed with a connecting opening adapted for removable insertion of a bulb. The fixing portion is connected to the main portion, and is fixedly connected to a respective one of the bulb seats, such that the connecting openings of the bulb connectors are oriented respectively toward the two directions. The circuit unit has two wires, each of which extends through the guiding hole of a respective one of the bulb seats for being electrically connected to a respective one of the bulb connectors.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
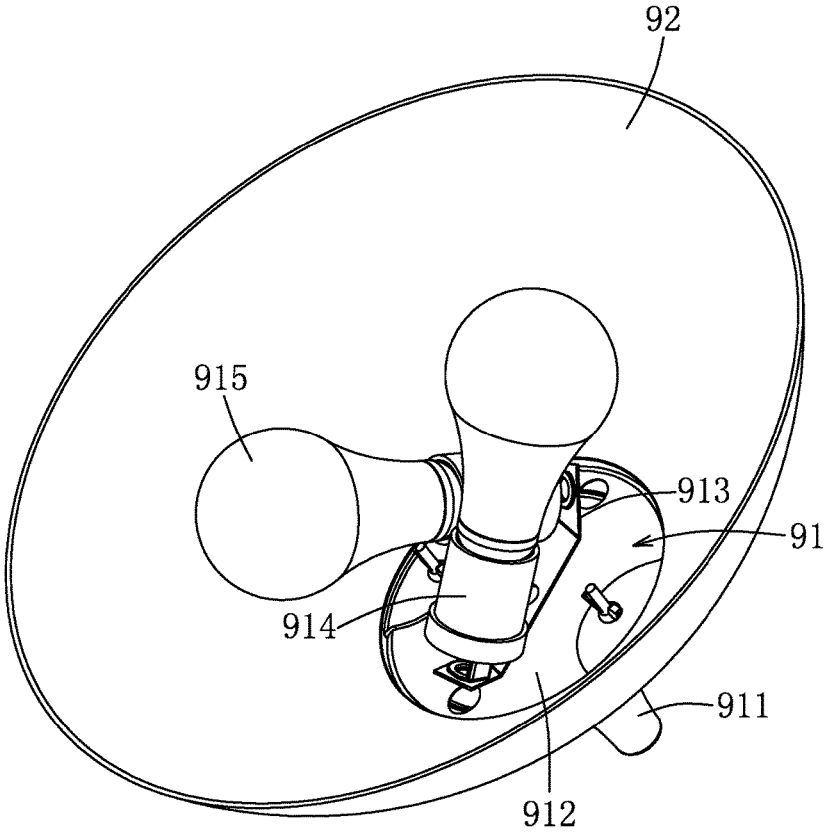
FIG. 1 PRIOR ART
FIG. 1 is a perspective view of a conventional lamp.
Figure 2:
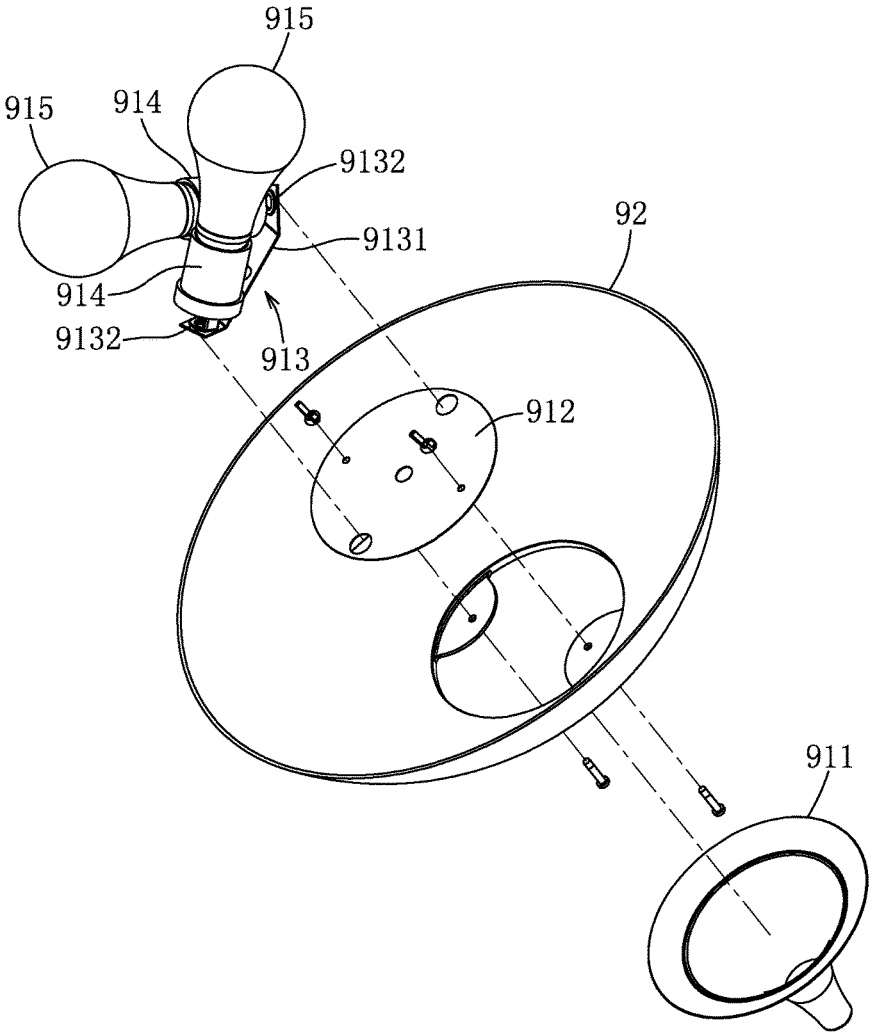
FIG. 2 PRIOR ART
FIG. 2 is a partly exploded perspective view of the conventional lamp.
Figure 3:
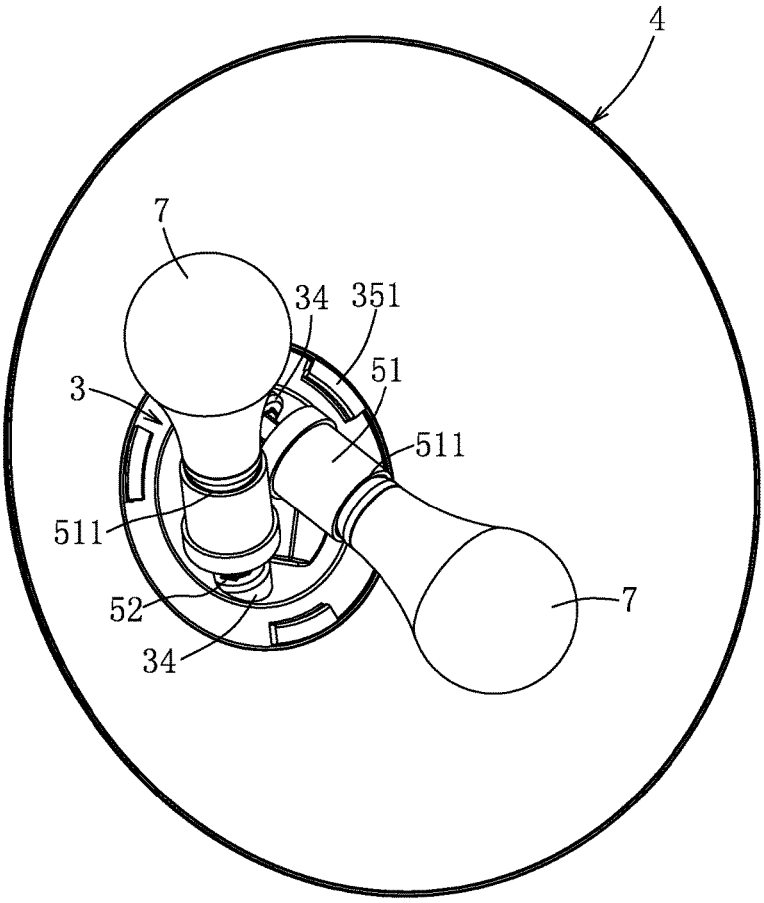
FIG. 3 is an assembled perspective view of an embodiment of a lamp according to the present disclosure.
Figure 4:
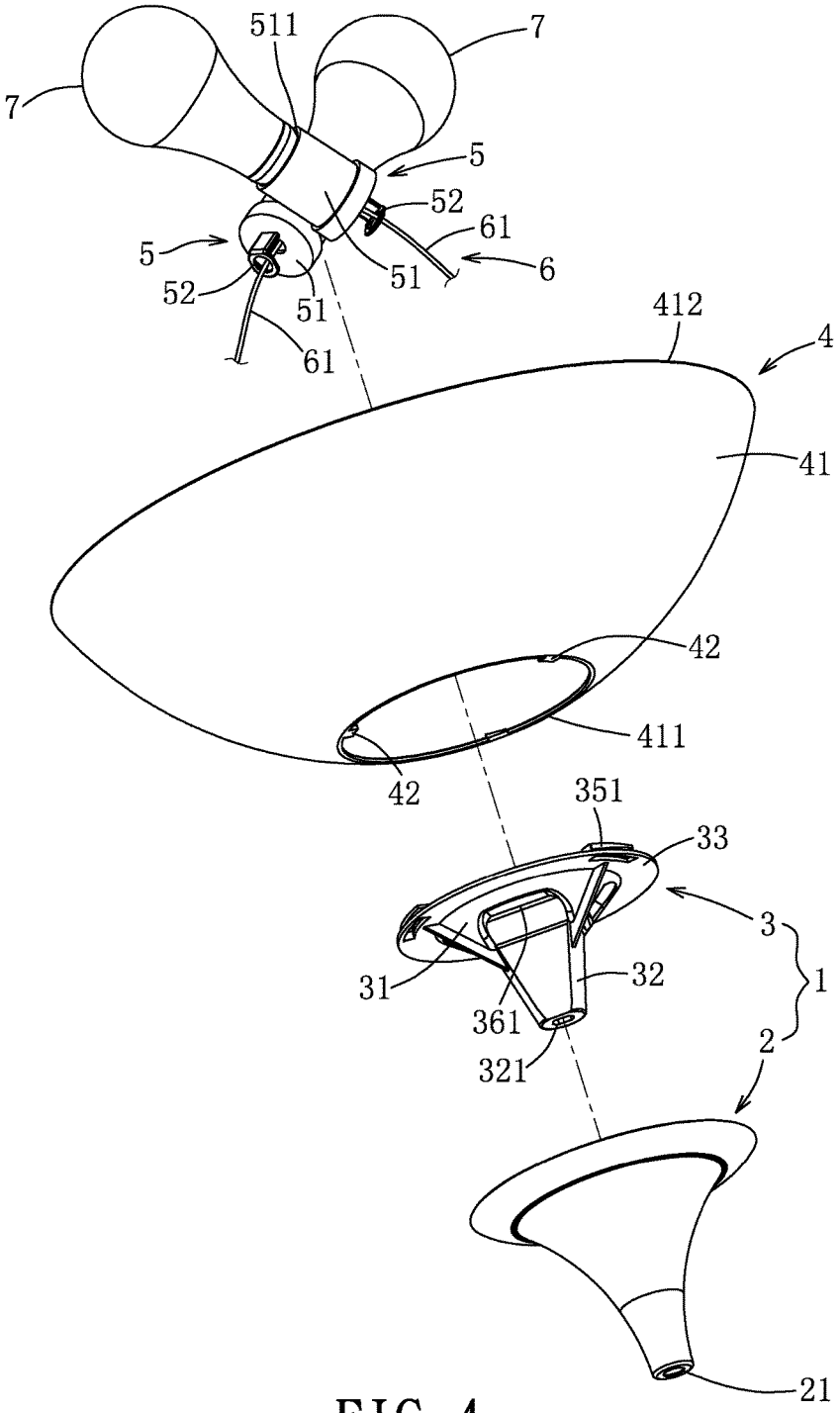
FIG. 4 is a fragmentary exploded perspective view of the embodiment.
Figure 5:
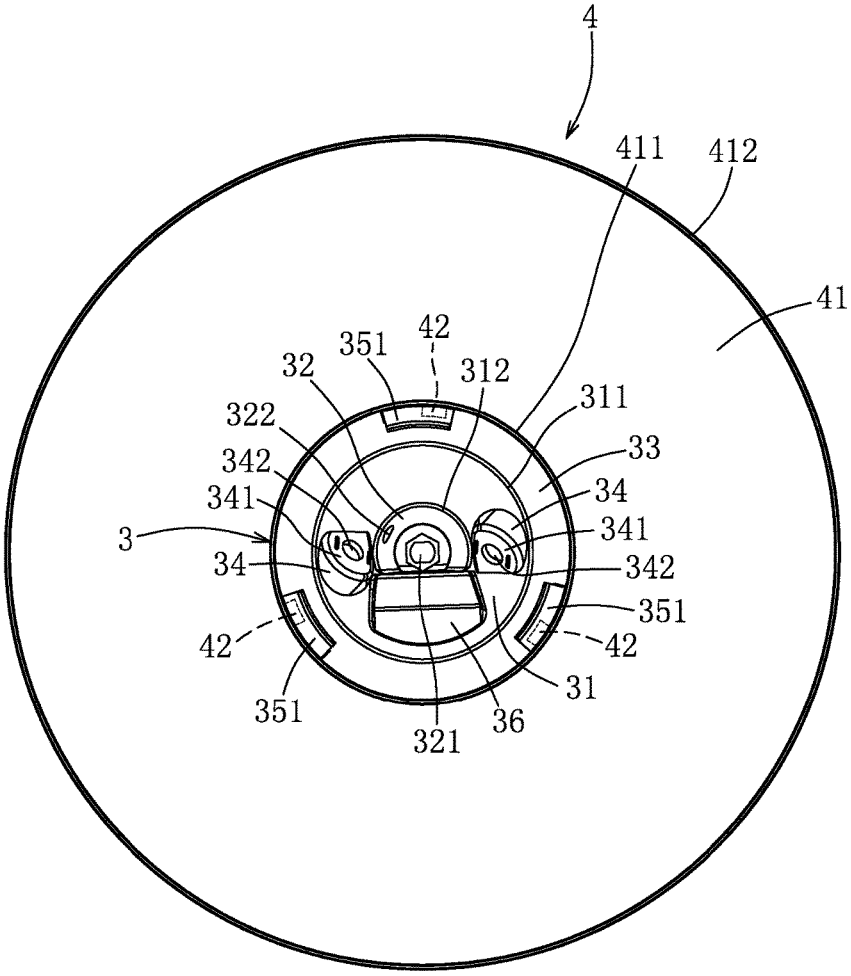
FIG. 5 is a top view of an inner seat and a lampshade of the embodiment.
Figure 6:
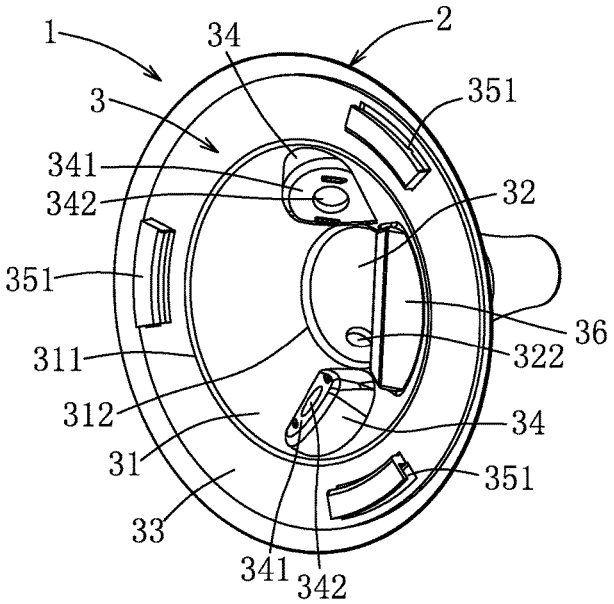
FIG. 6 is an assembled perspective view of the inner seat and an outer seat of the embodiment.
Figure 7:
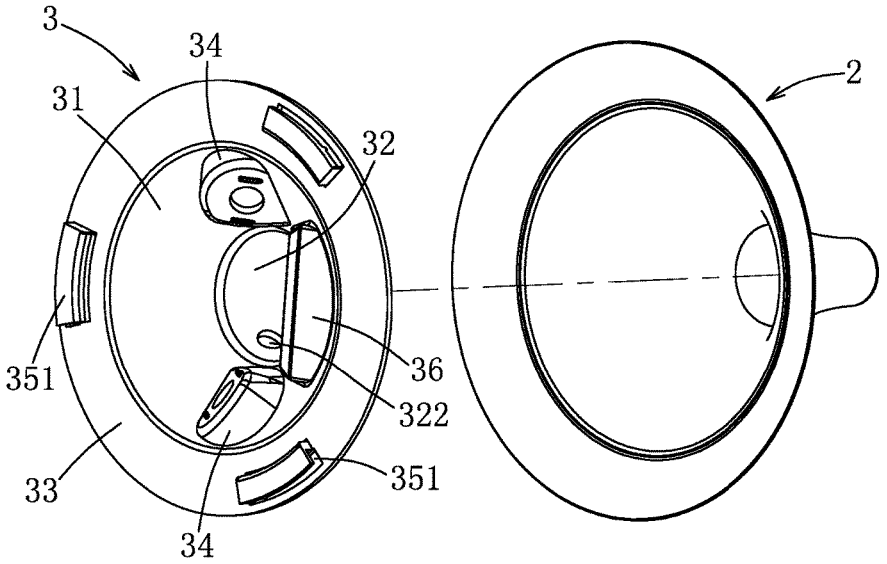
FIG. 7 is an exploded perspective view of the inner seat and the outer seat of the embodiment.

Referring to FIGS. 3 and 4, an embodiment of a lamp according to the present disclosure includes a seat unit 1, a lampshade 4, two bulb connectors 5, and a circuit unit 6.

Referring to FIGS. 5 to 8, the seat unit 1 has an outer seat 2, an inner seat 3 disposed in the outer seat 2, and opposite bulb seats 34 molded as one piece with the inner seat 3. The inner seat 3 has a first surrounding wall 31, a second surrounding wall 32, and a surrounding flange 33. The first surrounding wall 31 has a large open end 311, and a small open end 312 that is opposite to the large open end 311. The first surrounding wall 31 converges from the large open end 311 to the small open end 312. The second surrounding wall 32 extends from the small open end 312 of the first surrounding wall 31 and converges away from the first surrounding wall 31, is formed with a through hole 322, and has a distal end that is formed with a first opening 321. The surrounding flange 33 protrudes outwardly from the large open end 311 of the first surrounding wall 31. The inner seat 3 further has a plurality of angularly spaced-apart first engaging members 351 disposed on the surrounding flange 33, and an inwardly-protruding receiving member 36 provided on the first surrounding wall 31, and defining a receiving space 361 outside of the first surrounding wall 31.

The bulb seats 34 are provided on the first surrounding wall 31 of the inner seat 3. Each of the bulb seats 34 has a mounting surface 341 and a guiding hole 342. The mounting surfaces 341 of the bulb seats 34 respectively face toward two directions which are transverse to each other. In this embodiment, each of the bulb seats 34 protrudes inwardly and defines a recess outside of the first surrounding wall 31.

Figure 8:
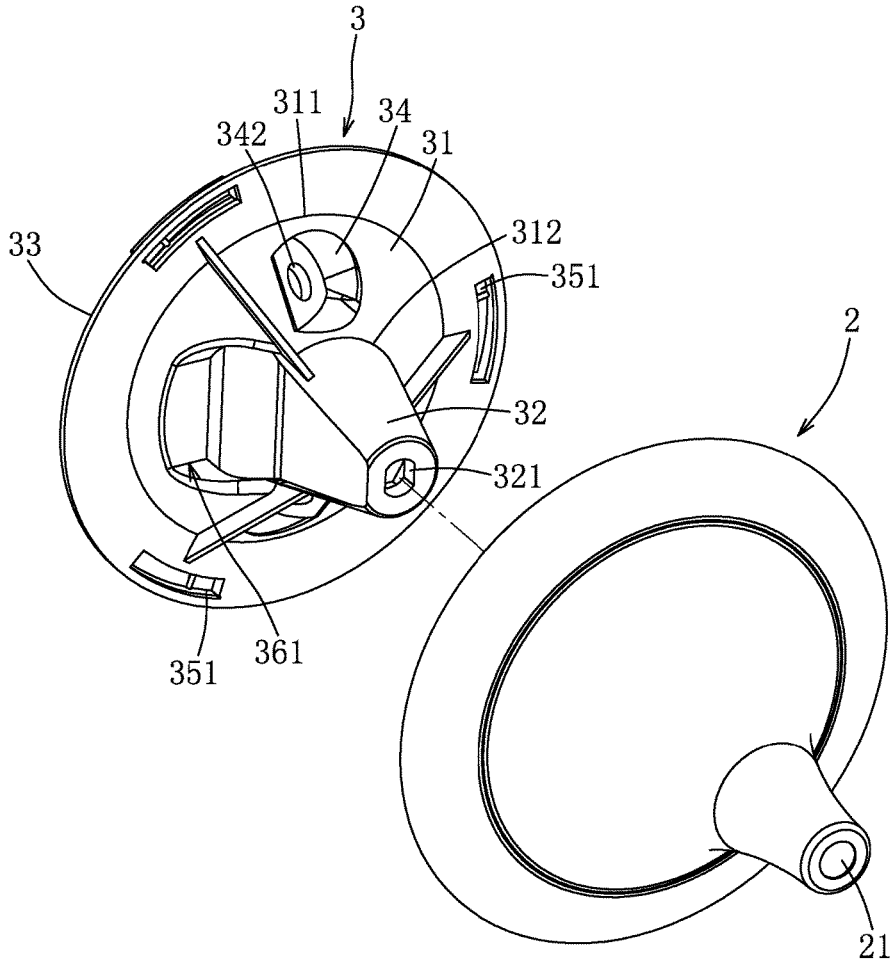
FIG. 8 is another exploded perspective view of the inner seat and the outer seat.
Figure 11:
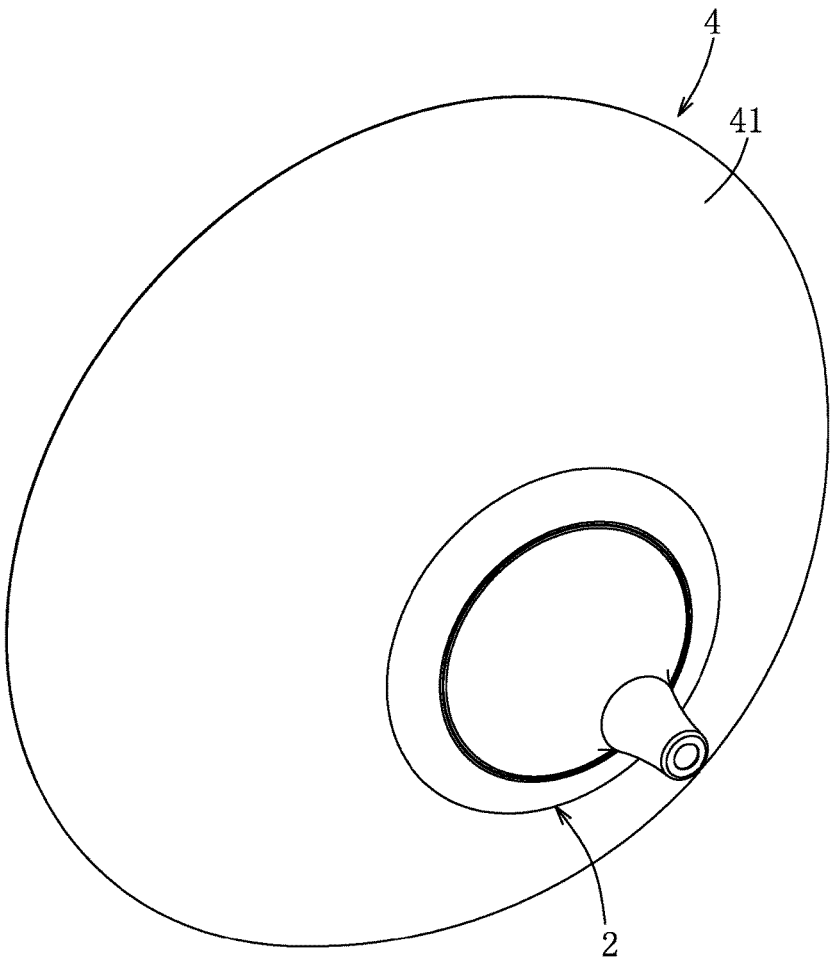
FIG. 11 is a perspective view illustrating the outer seat being connected to the lampshade.

Referring to FIGS. 8 and 11, the outer seat 2 is connected to the lampshade 4, covers the inner seat 3, and has a second opening 21 communicating with the first opening 321 of the inner seat 3.

Figure 9:
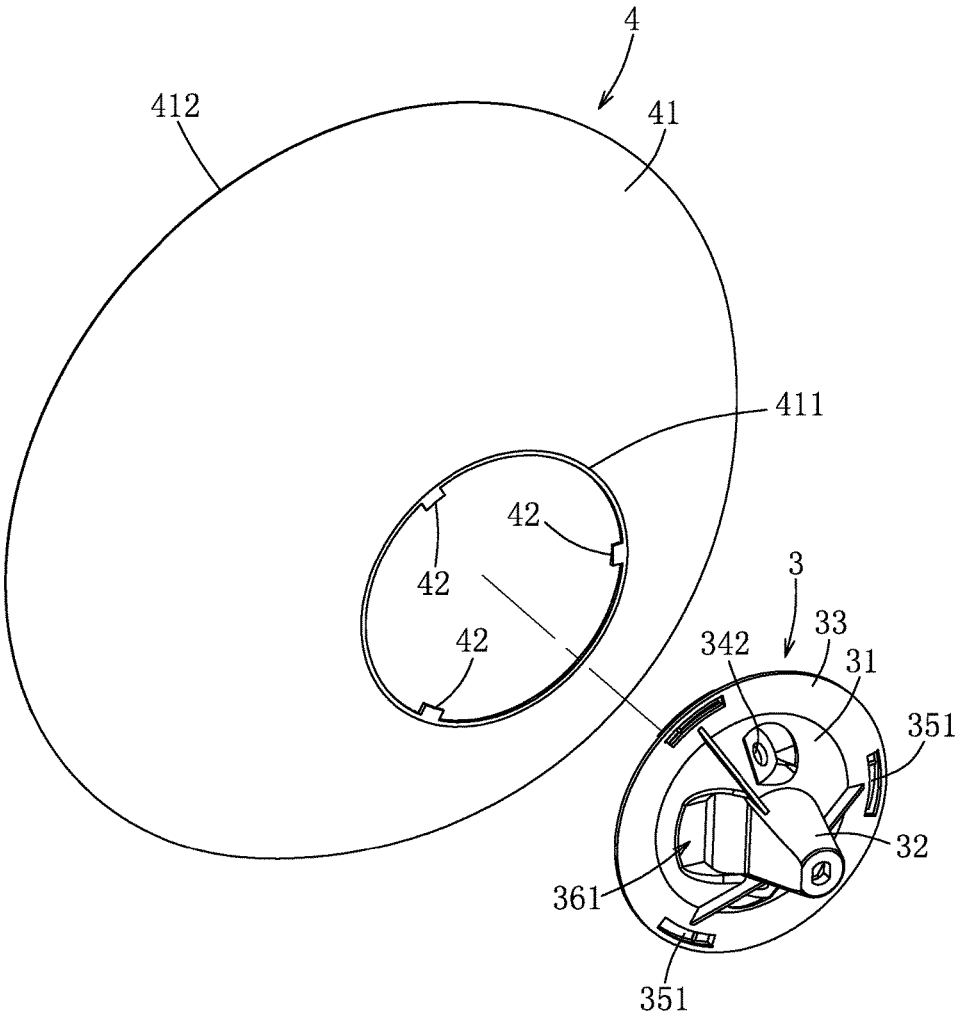
FIG. 9 is an exploded perspective view of the inner seat and the lampshade.
Figure 10:
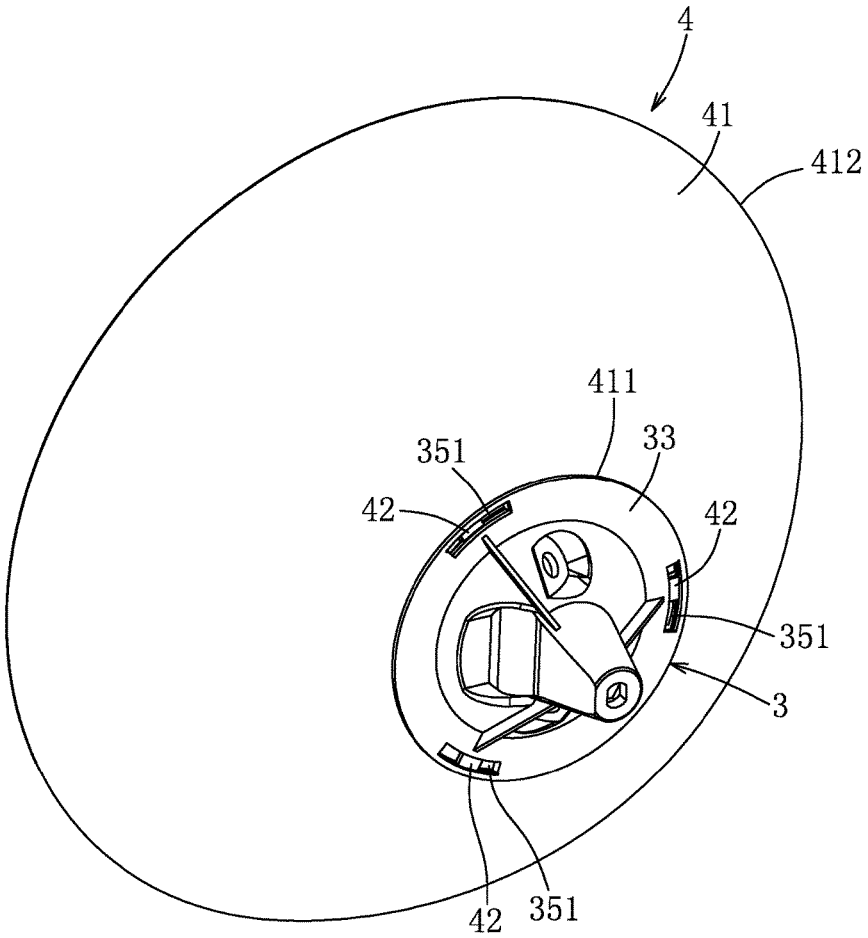
FIG. 10 is an assembled perspective view of the inner seat and the lampshade.

Referring to FIGS. 9 and 10, the lampshade 4 has a shade body 41 and a plurality of angularly spaced-apart second engaging members 42. The shade body 41 has an inner end 411 and an outer end 412 that is opposite to the inner end 411. In this embodiment, the inner and outer ends 411, 412 are circular open ends. The shade body 41 converges from the outer end 412 to the inner end 411. The second engaging members 42 are connected to the inner end 411, and respectively correspond in position with the first engaging members 351.

The surrounding flange 33 of the inner seat 3 surrounds an axis. The first engaging members 351 of the inner seat 3 extend along an imaginary circle that surrounds the axis. In this embodiment, each of the first engaging members 351 is configured as a groove, and each of the second engaging members 42 of the lampshade 4 protrudes inwardly from the inner end 411 of the shade body 41. The second engaging members 42 respectively and removably engage the first engaging members 351 for coupling the lampshade 4 to the inner seat 3. The lampshade 4 is rotatable about the axis relative to the inner seat 3 to allow the second engaging members 42 to be respectively disengaged from the first engaging members 351, so as to be separated from the inner seat 3.

Referring back to FIGS. 3 to 5, each of the bulb connectors 5 has a main portion 51 and a fixing portion 52. The main portion 51 is formed with a connecting opening 511 adapted for removable insertion of a bulb 7. The fixing portion 52 is connected to the main portion 51, and is fixedly connected to a respective one of the bulb seats 34, such that the connecting openings 511 of the bulb connectors 5 are oriented toward the two directions which are transverse to each other, and that the bulbs 7 respectively emit light in the two directions.

The control unit 6 has two wires 61, each of which has an end that extends through the guiding hole 342 of a respective one of the bulb seats 34 for being electrically connected to a respective one of the bulb connectors 5, and an opposite end that extends into an internal space surrounded by the second surrounding wall 32 through the through hole 322, and that further extends outwardly of the inner and outer seats 3, 2 through the first and second openings 321, 21. The receiving space 361 of the inner seat 3 is adapted to receive, for example, a control circuit (not shown) for controlling the control unit 6.

In this embodiment, the lampshade 4 and the inner seat 3 are made of plastic material, the outer seat 2 is made of metal, and the inner seat 3 is molded as one piece. The fixing portions 52 of the bulb connectors 5 may be respectively insert-molded into the bulb seats 34, or connected to the bulb seats 34 using a different technique in other embodiments.

In summary, due to integrated configuration of the inner seat 3, the bulb seats 34 and the fixing portions 52 of the bulb connectors 5, the assembly time of the lamp according to the present disclosure is reduced. In addition, by virtue of the engagement between the inner seat 3 and the lampshade 4, an operator can conveniently complete the assembly of the lamp in a quick and easy manner without using screws or other fastening members, thereby reducing the assembly cost of the lamp.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that his disclosure is not limited to the disclosed embodiment but is intended to cover various arrangements included within the spirit and scope of the broadest interpretation so as to encompass all such modifications and equivalent arrangements.

What is claimed is:

1. A lamp comprising:

a seat unit having an outer seat, an inner seat that is disposed in said outer seat, and opposite bulb seats that are molded as one piece with said inner seat, each of said bulb seats having a mounting surface and a guiding hole, said mounting surfaces of said bulb seats respectively facing toward two directions which are transverse to each other;

a lampshade connected to said seat unit;

two bulb connectors, each of which having a main portion that is formed with a connecting opening adapted for removable insertion of a bulb, and a fixing portion that is connected to said main portion, and that is fixedly connected to a respective one of said bulb seats, such that said connecting openings of said bulb connectors are oriented respectively toward the two directions; and a circuit unit having two wires, each of which extends through said guiding hole of a respective one of said bulb seats for being electrically connected to a respective one of said bulb connectors.

2. The lamp as claimed in claim 1, wherein:

said inner seat has a first surrounding wall having a large open end, and a small open end that is opposite to said large open end, said first surrounding wall converging from said large open end to said small open end, a second surrounding wall extending from said small open end of said first surrounding wall, converging away from said first surrounding wall, and having a distal end that is formed with a first opening, and a surrounding flange protruding outwardly from said large open end of said first surrounding wall; and said bulb seats protrude inwardly and are provided on said first surrounding wall.

3. The lamp as claimed in claim 2, wherein:

said inner seat further has a plurality of angularly spaced-apart first engaging members disposed on said surrounding flange; and said lampshade has a shade body having an inner end and an outer end that is opposite to said inner end, said shade body converging from said outer end to said inner end, and a plurality of angularly spaced-apart second engaging members connected to said inner end, and respectively and removably engaging said first engaging members for coupling said lampshade to said inner seat.

4. The lamp as claimed in claim 3, wherein:

said surrounding flange of said inner seat surrounds an axis;

said first engaging members of said inner seat extend along an imaginary circle that surrounds the axis, each of said first engaging members being configured as a groove; and each of said second engaging members of said lampshade protrudes inwardly from said inner end of said shade body, said lampshade being rotatable about the axis to respectively disengage said second engaging members from said first engaging members.

5. The lamp as claimed in claim 2, wherein said inner seat further has an inwardly-protruding receiving member provided on said first surrounding wall, and defining a receiving space outside of said first surrounding wall.

6. The lamp as claimed in claim 5, wherein each of said bulb seats defines a recess outside of said first surrounding wall.

* * * * *